US005849051A

United States Patent [19]

Beardsley et al.

[11] Patent Number: 5,849,051

[45] Date of Patent: Dec. 15, 1998

[54] ABRASIVE FOAM ARTICLE AND METHOD OF MAKING SAME

[75] Inventors: Kris A. Beardsley, Roseville; Jonathan M. Lise, Woodbury; Chris A. Minick, Stillwater, all of Minn.; Richard B. Muir, Kanata, Canada; Brent D. Niccum, North St. Paul, Mich.; Rufus C. Sanders, Jr., Burnsville, Minn.; Jeffrey D. Sheely, West Lakeland, Minn.

[73] Assignee: Minnesota Mining and Manufacturing Company, St. Paul, Minn.

[21] Appl. No.: 968,393

[22] Filed: Nov. 12, 1997

[51] Int. Cl.[6] ..... B24D 11/00

[52] U.S. Cl. ..... 51/295; 51/296; 51/298

[58] Field of Search ..... 51/295, 296, 298

[56] References Cited

U.S. PATENT DOCUMENTS

| | | | |
|---|---|---|---|
| 2,596,565 | 5/1952 | Kautenberg . | |
| 3,401,491 | 9/1968 | Schnabel et al. | 51/295 |
| 3,630,800 | 12/1971 | Nash et al. . | |
| 3,701,703 | 10/1972 | Zimmer, Jr. et al. . | |
| 3,773,480 | 11/1973 | Hall et al. . | |
| 3,918,220 | 11/1975 | Jury et al. . | |
| 4,427,712 | 1/1984 | Pan . | |
| 4,569,861 | 2/1986 | Smith et al. | 427/244 |
| 4,613,345 | 9/1986 | Thicke et al. | 51/293 |
| 4,966,609 | 10/1990 | Callinan et al. . | |
| 5,152,809 | 10/1992 | Mattesky | 51/295 |
| 5,242,749 | 9/1993 | Bayle et al. . | |
| 5,307,593 | 5/1994 | Lucker et al. . | |
| 5,429,545 | 7/1995 | Meyer | 451/523 |
| 5,595,578 | 1/1997 | Stubbs et al. | 51/295 |
| 5,609,513 | 3/1997 | Stark . | |
| 5,681,361 | 10/1997 | Sanders, Jr. . | |

FOREIGN PATENT DOCUMENTS

| | | |
|---|---|---|
| 0 010 408 B1 | 2/1983 | European Pat. Off. . |
| 0 562 919 A1 | 9/1993 | European Pat. Off. . |
| 0 192 047 A2 | 8/1996 | European Pat. Off. . |
| 2103043 | 4/1972 | France . |
| 27 22 083 | 11/1978 | Germany . |
| 52-118689 | 10/1977 | Japan . |
| 55-112775 | 8/1980 | Japan . |
| 61-025776 | 2/1986 | Japan . |
| 2311273 | 12/1990 | Japan . |
| 5220670 | 8/1993 | Japan . |
| 939361 | 10/1963 | United Kingdom . |
| 1 328 292 | 8/1973 | United Kingdom . |
| 2 070 637 | 9/1981 | United Kingdom . |
| WO 97/42003 | 11/1997 | WIPO . |

*Primary Examiner*—Deborah Jones
*Attorney, Agent, or Firm*—Scott A. Bardell

[57] ABSTRACT

Abrasive foam articles and a method of manufacture of such articles are described. The articles of the invention comprise a flexible and resilient foam substrate having first and second major substrate surfaces, at least one of the surfaces having a plurality of open cells substantially across the substrate surface, the open cells having coatable surfaces defined by interconnected voids; and a plurality of abrasive particles adhered to said coatable surfaces of said open cells in a substantially uniform manner.

11 Claims, 4 Drawing Sheets

ABRASIVE FOAM ARTICLE AND METHOD OF MAKING SAME

The present invention relates to abrasive foam articles having a desired distribution of abrasive particles.

BACKGROUND OF THE INVENTION

The manufacture and use of abrasive particle-containing foams, or "sanding sponges", have long been known. Such abrasive articles have been found useful in cleaning, polishing, abrading, and dimensioning materials such as wood, metal, plastic, and the like, especially when such materials have and are to retain irregular, relieved, or otherwise intricate surface contours, or, when the manual control of working pressures between the abrasive article and the workpiece is desirable, such as when abrading interior drywall surfaces.

Such abrasive foams have abrasive particles dispersed within an open- or closed-cell foam, such as those described in U.S. Pat. Nos. 4,613,345 and 4,569,861, or alternatively, have the abrasive particles adhered to at least one major surface of same such as described in U.S. Pat. No. 5,429,545. Some have fibrous reinforcements disposed within them, such as the articles described in U.S. Pat. Nos. 3,630,800 and 5,242,749. In other such articles, the foams have been comminuted, mixed with abrasive particles and binder, and then re-consolidated into an abrasive article, such as the articles of U.S. Pat. No. 3,773,480 and GB 1,328,292. Abrasive-containing foam structures have also been made of more rigid foams, such as those described in EP 0 192 047.

However, when flexible, resilient abrasive articles having abrasive particles adhesively bound to a major surface of a foam substrate are desired, it is known that the selection of the adhesive binder is critical to maintain the physical properties of the flexible, resilient substrate, such as is taught in U.S. Pat. Nos. 4,966,609 and 5,609,513, which require flexible, elastomeric binders to maintain these qualities.

When hard, non-elastomeric binders such as phenol-formaldehyde condensates are employed, the resilient, elastomeric qualities of the foam substrates are quickly overcome by the physical properties of these binders, rendering the resultant abrasive article brittle and susceptible to cracking, tearing, and puncturing under normal use. This problem has been addressed, for example, in EP 0 010 408, which describes use of a template or mask to apply, or "print" such hard, non-elastomeric binders in predetermined, discontinuous patterns and simultaneously or subsequently applying abrasive particles to these printed patterns of binder. This technique does overcome some of the deficiencies described above, but still leave areas susceptible to brittle failure and introduce the problem of non-uniform abrasion such as "tracking" or "scoring" of the workpiece by the abrasive article due to the discontinuous placement of the abrasive elements of the article.

The application of uniform coatings of various compositions to fabrics, paper, or wood by the use of mechanical foaming or "frothing" techniques is known, such as that described in DE 2,722,083, wherein energy requirements for drying the compositions are reduced. However, the retention of critical physical properties to resilient, elastomeric open- or closed-cell foam substrates coated with a hard, non-elastomeric binder was not described nor anticipated.

FIG. 1 shows an abrasive with particles applied via spraying a resinous slurry wherein the resinous adhesive forms agglomerates 12 along the coatable surfaces 10 of the foam substrate with the fine abrasive particles dispersed and engulfed within the resin. Because the particles are applied to the foam substrate in a resinous slurry, the fine abrasive particles tend to become engulfed in the cured resin and the resulting abrasive article has a substantially non-uniform distribution of the agglomerated resin and the fine abrasive particles along the coatable surfaces of the substrate. In such a construction, the fine abrasive particles may not be immediately available in abrading applications of the finished article, possibly making the overall abrasive performance of the articles less than optimum and leaving room for improvement in performance.

SUMMARY OF THE INVENTION

The present invention provides abrasive articles which include fine abrasive particles adhered to the coatable surfaces of the open cells of a foam substrate in a desirable particle distribution. The articles are useful in abrasive applications such as finishing and polishing of metal, wood and plastic surfaces, for example, and especially in the automobile aftermarket industry where the articles are useful to treat painted automobile panels and the like. In the manufacture of such articles, fine abrasive particles are deposited onto the coatable surfaces of the open cells of a foam substrate so that the particles are distributed in a substantially uniform manner along the surfaces of the open cells to provide an abrasively effective article. Surprisingly, the abrasive articles of the invention maintain a substantial degree of the properties of the uncoated foam substrate (e.g., resilience, flexibility) when a hard, non-elastomeric binder or adhesive is used to adhere the abrasive particles to the substrate. In other words, the resulting abrasive foam articles of the invention are conformable, flexible abrasive articles.

In describing the present invention, "resilient" refers to a property of a substrate which enables the substrate to substantially recover its original shape after being bent, stretched or compressed.

"Flexible abrasive article" refers to an abrasive article which when folded onto itself with the abrasive surface out that does result in knife-edging of the abrasive coating.

"Foam substrate" refers to a foam substrate having open cells defined by interconnecting voids throughout at least one surface of the substrate. For example, a foam substrate as used herein includes a substantially closed cell foam having at least one surface comprised of open cells.

"Hard, non-elastomeric adhesive" refers to a cured adhesive that has significantly less elastomeric properties than the foam substrate.

"Make coat precursor" refers to the coatable resinous adhesive material applied to the coatable surfaces of the open cells of the foam substrate to secure abrasive particles thereto. "Make coat" refers to the layer of hardened resin over the coatable surfaces of the open cells of the foam substrate formed by hardening the make coat precursor. "Size coat precursor" refers to the coatable resinous adhesive material applied to the coatable surfaces of the open cells of the foam substrate over the make coat. "Size coat" refers to the layer of hardened resin over the coatable surfaces of the open cells of the foam substrate formed by hardening the size coat precursor. "Cured" or "fully cured" means a hardened polymerized curable coatable resin. "Fine abrasive particles" refers to abrasively effective particles comprising any of the materials set forth herein and having distribution of particle sizes wherein the median particle diameter is about 60 microns or less. A spherical particle shape is assumed in referring to the median particle diameter, based on standard test methods available for the determination of particle diameters such as, for example ANSI test method B74.18-1884. "Substantially uniform" in referring to the distribution of fine abrasive particles along the contours and walls i.e., coatable surfaces, defined by interstices or voids means that the particles in the finished articles are distributed along coatable surfaces of the open cells without significant agglomeration of the resin and the particles, as may be visually observed by microscopic examination of the cells. In the finished article, the majority of the particles are positioned along the coatable surfaces of the open cells to be abrasively effective in the initial application of the article.

In referring to the binder compositions of the make and size coats, "Labile" means a foamed or frothed condition imparted to a liquid dispersion of binder material (e.g., a make coat precursor or a size coat precursor) so that the frothed state of the binder dispersion is transitory. By the term "froth", it is meant a dispersion of gas bubbles throughout a liquid where each bubble is enclosed within a thin film of the liquid. The labile foams utilized in the invention thus also encompass unstable foam consisting of relatively large bubbles of gas.

In one aspect, the invention provides an abrasive article, comprising:

a flexible and resilient foam substrate having first and second major substrate surfaces, at least one of the surfaces having a plurality of open cells substantially across the substrate surface, the open cells having coatable surfaces defined by interconnected voids; and a plurality of abrasive particles adhered to said coatable surfaces of said open cells in a substantially uniform manner.

Preferably, only the open cell surfaces of the first and/or second major substrate surfaces will include abrasive particles adhered thereto, and the particles may comprise any of a variety of suitable abrasive materials. The particles are bonded to the coatable surfaces of the open cells of the foam substrate with a suitable adhesive which may comprise hard, non-elastomeric thermoplastic or thermosetting resins. Preferably, the particles are secured to the coatable surfaces of the open cells by utilizing a thermosetting phenolic resin make coat and, optionally, a similar size coat. Preferably, most of the abrasive particles deposited onto the resin make coat precursor are attached to the open cells at the surface of the foam substrate. Preferably, at least about 80 percent by weight of the abrasive particles deposited on the resin make coat precursor are attached to the open cells of the foam substrate at locations within a vertical distance measured from the coated external surface that is no greater than about 25%, more preferably no greater than about 15%, of the overall thickness of the foam substrate. Therefore, for an open cell foam substrate having an overall thickness of 10 mm, at least about 80% by weight of the abrasive particles applied to the resin make coat precursor, are bonded to the open cells located within a vertical distance of 2.5 mm from the coated external surface. However, it is envisioned that the penetration of the frothed resin adhesive into a fully reticulated foam substrate may be throughout the substrate with the abrasive particles uniformly distributed along the open cells as described above with the article retaining a substantial degree of the properties of the uncoated substrate.

The articles of the invention may be provided in the form of hand pads, endless belts, discs, densified or compressed wheels and the like. Additionally, the articles of the invention can be laminated to other articles such as nonwoven, closed cell foam, open cell foam, or rigid foam substrates and the like or the articles can be provided a in a roll form with or without perforations therein.

In the preparation of the foregoing articles; a foam substrate is prepared or is otherwise provided. A make coat precursor composition is applied to the external surface of the foam substrate to form a first coating layer. A plurality of the foregoing fine abrasive particles is applied to the first coating layer, and the make coat precursor composition is at least partially cured. Optionally, a size coat precursor composition is applied over the abrasive particles and the first coating layer to form a second coating layer. The first and second coating layers are cured to affix the abrasive particles to the coatable surfaces of the open cells of the foam substrate to provide the abrasive article wherein the particles are affixed to the open cell surfaces in a substantially uniform distribution along the contours and "walls" thereof.

The fine abrasive particles are deposited onto the make coat precursor, preferably by depositing the particles first on one major surface of the foam substrate and then over the second major surface of the foam substrate using the deposition method described in commonly assigned co-pending international application no. PCT/US96/06276 filed May 3, 1996 and corresponding to U.S. application Ser. No. 08/930,098, entitled "Method and Apparatus for Manufacturing Abrasive Articles", filed concurrently herewith and incorporated by reference herein. Larger abrasive particles, i.e., >60 micron diameter, are preferably applied to the make coat precursor by known methods such as drop coating or electrostatic coating. Preferably, the make and size coat precursors are thermosetting, coatable, phenolic resins which are provided as labile foams. The make coat precursor is frothed prior to its application to the foam substrate, and is thereafter allowed to at least partially break down prior to the application of abrasive particles. Likewise, the optional size coat, when applied to the article, is preferably frothed and then applied over the at least partially cured make coat. The make coat precursor and size coat precursor are then fully cured to provide the abrasive articles of the invention, and the thus prepared articles may be further processed to provide hand pads, endless belts, discs, densified or compressed wheels and the like.

The additional details of the invention will be more fully appreciated by those skilled in the art upon consideration of the remainder of the disclosure including the detailed description of the preferred embodiment and the appended claims.

BRIEF DESCRIPTION OF THE DRAWINGS

In describing the various aspects of the preferred embodiment, reference is made to the Figures, wherein.

DETAILED DESCRIPTION OF THE PREFERRED EMBODIMENT

Figure 1:
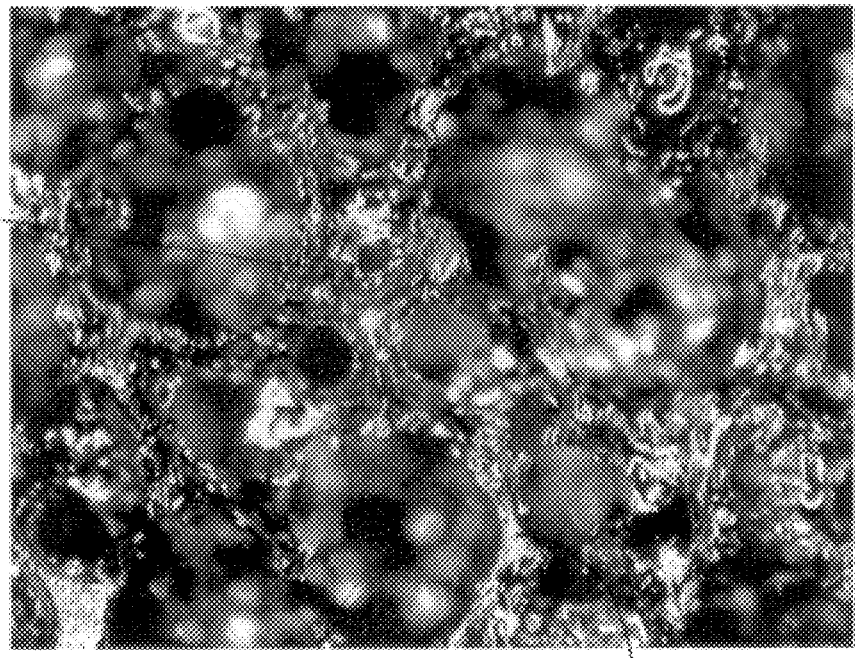
FIG. 1 is an enlarged photograph of a portion of an abrasive article showing individual open cells of a foam substrate with abrasive particles adhered to the open cells using a resinous slurry.

Details of the preferred embodiment of the invention will now be described. It will be understood by those skilled in the art that the details of the embodiments discussed below are not intended to be limiting in any way but merely illustrative of the features of the invention. In describing the preferred embodiment, reference is made to the figures wherein structural features are identified by reference numerals and wherein identical reference numerals indicate identical structures.

Figure 2:
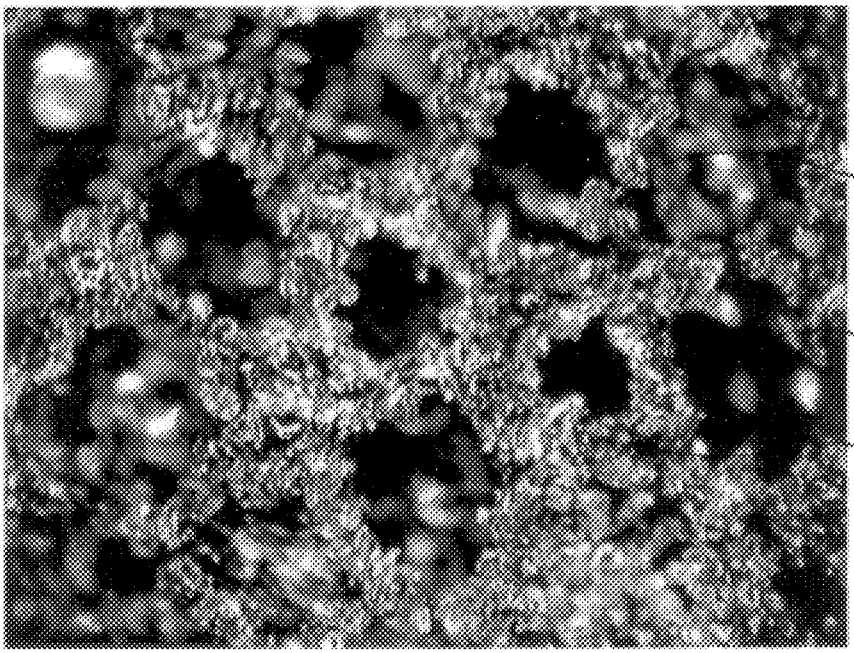
FIG. 2 is an enlarged photograph of a portion of a abrasive article showing individual open cells with abrasive particles adhered to the coatable surfaces of the open cells according to the invention.

As shown in FIG. 2, the articles of the invention comprise a foam substrate having open cells 100 on at least one surface of the substrate. The open cells comprise coatable surfaces 102 defined by interstices or voids 104 also called "pores." A plurality of abrasive particles 106 are bonded to the coatable surfaces of the cells by cured resinous binders applied to the foam substrate to provide make and size coats, as described herein. The abrasive particles are arranged in a preferred distribution along the coatable surfaces of the cells so that the particles are distributed in a substantially uniform manner along the coatable surfaces of the cells which are defined by voids and without burying the cells in agglomerated resin. In this construction, the particles are positioned to be immediately effective in initial abrasive applications of the finished article. The abrasive articles of FIGS. 1 and 2 were made using the same type and composition of foam substrates and the same make coat resin.

Foam Substrate

The gas phase in a cellular polymer or foam is distributed in interstices or voids called cells. If these cells are interconnected in such a manner that gas can pass from one cell to another, the foam is termed open-celled. In contrast, if the cells are discrete and the gas phase of each is independent of that of the other cells, the foam is termed closed-celled. When the fraction of open cells in a foam is greater than the fraction of closed cells, the foam is an open-celled foam. The closed cell content of a foam may be measured by means of an airflow manometer described in ASTM method D3574.

In general, any resilient and flexible foam substrate having open cells with coatable surfaces on at least one surface of the substrate may be used in the abrasive articles of the invention. Preferred foam substrates have between about 4 to about 100 pores per inch (ppi) (mean pore diameter of 6 to 0.25 mm). Foam substrates having greater than about 100 ppi have surfaces that behave as solid surfaces. Such solid surfaces may be coated by the method of the invention however, such foam substrates may not maintain the properties of the uncoated foam substrate due to non-uniform application of the resin and the particles. Useful foam substrates include those made from synthetic polymer materials, such as, polyurethanes, foam rubbers, and silicones, and natural sponge materials.

The thickness of the foam substrate is only limited by the desired end use of the abrasive article. Preferred foam substrates have a thickness than ranges from about 1 mm to about 50 mm.

Adhesive Binder

As is described in more detail below, an adhesive layer is formed from the application to the foam substrate of a resinous make coat precursor or first resin and, optionally, a size coat precursor or second resin applied over the make coat precursor. Preferably, the adhesive layer is formed from the make coat precursor and the size coat precursor which have been applied to the foam substrate at a coating weight which, when hardened, provides the necessary adhesion to strongly bond abrasive particles to the fibers. In the finished articles of the invention, the adhesive layer provides a thin coating of resin over the fine abrasive particles without burying the particles within the resin. When observed under a microscope, for example, the individual particles are observed to be anchored to the void defined coatable surfaces of the cells and to extend outwardly from the outer surfaces of the coatable surfaces. In this construction, the fine abrasive particles are positioned in the article to be immediately abrasively effective in the initial applications of the finished article. Moreover, the particles are strongly adhered to the coatable surfaces of the open to provide an abrasive article with a satisfactory work life.

The make coat precursor suitable for use in the invention is a coatable, hardenable adhesive binder and may comprise one or more thermoplastic or, preferably, thermosetting resinous adhesives. Resinous adhesives suitable for use in the present invention include phenolic resins, aminoplast resins having pendant $\alpha,\beta$- unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof. Catalysts and/or curing agents may be added to the binder precursor to initiate and/or accelerate the polymerization process.

Epoxy resins have an oxirane and are polymerized by the ring opening. Such epoxide resins include monomeric epoxy resins and polymeric epoxy reins. These resin can vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxypropoxy)-phenyl)propane (diglycidyl ether of bisphenol a)] and commercially available materials under the trade designation "Epon 828", "Epon 1004" and "Epon 1001 F" available from Shell Chemical Co., "DER-331", "DER-332" and "DER-334" available from Dow Chemical Co. Other suitable epoxy resins include glycidyl ethers of phenol formaldehyde novolac (e.g., "DEN-431" and "DEN-428" available from Dow Chemical Co.

Examples of ethylenically unsaturated binder precursors include aminoplast monomer or oligomer having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions or mixtures thereof.

The aminoplast binder precursors have at least one pendant alpha, beta-unsaturated carbonyl group per molecule or oligomer. These materials are further described in U.S. Pat. Nos. 4,903,440 (Larson et al.) and 5,236,472 (Kirk et al.), both incorporated herein by reference.

The ethylenically unsaturated monomers or oligomers may be monofunctional, difunctional, trifunctional or tetrafunctional or even higher functionality. The term acrylate includes both acrylates and methacrylates. Ethylenically unsaturated binder precursors include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloxyethyl) isocyanurate, 1,3,5-tri(2-methyacryloxyethyl)-s-triazine, acrylamide, methylacrylamide, N-methyl-acrylamide, N,N-dimethylacrylamide, Nvinylpyrrolidone, and N-vinylpiperidone.

Isocyanurate derivatives having at least one pendant acrylate group and isocyanate derivatives having at least one pendant acrylate group are further described in U.S. Pat. No. 4,652,274 (Boettcher et al.), incorporated herein by reference. The preferred isocyanurate material is a triacrylate of tris(hydroxy ethyl) isocyanurate.

Acrylated urethanes are diacrylate esters of hydroxy terminated isocyanate extended polyesters or polyethers. Examples of commercially available acrylated urethanes include "UVITHANE 782", available from Morton Chemical, and "CMD 6600", "CMD 8400", and "CMD 8805", available from UCB Radcure Specialties. Acrylated epoxies are diacrylate esters of epoxy resins, such as the diacrylate esters of bisphenol A epoxy resin. Examples of commercially available acrylated epoxies include "CMD 3500", "CMD 3600", and "CMD 3700", available from UCB Radcure Specialties.

Acrylated urethanes are diacrylate esters of hydroxy terminated NCO extended polyesters or polyethers. Examples commercially available acrylated urethanes include UVITHANE 782, available from Morton Thiokol Chemical, and CMD 6600, CMD 8400, and CMD 8805, available from Radcure Specialties.

Acrylated epoxies are diacrylate esters of epoxy resins, such as the diacrylate esters of bisphenol A epoxy resin. Examples of commercially available acrylated epoxies include CMD 3500, CMD 3600, and CMD 3700, available from Radcure Specialties.

Examples of ethylenically unsaturated diluents or monomers can be found in U.S. patent application Ser. No. 08/5,236,472 (Kirk et al.) and U.S. patent application Ser. No. 08/144,199 (Larson et al.); the disclosures of both patent applications are incorporated herein by reference. In some instances these ethylenically unsaturated diluents are useful because they tend to be compatible with water.

Additional details concerning acrylate dispersions can be found in U.S. Pat. No. 5,378,252 (Follensbee), incorporated herein by reference.

It is also within the scope of this invention to use a partially polymerized ethylenically unsaturated monomer in the binder precursor. For example, an acrylate monomer can be partially polymerized and incorporated into the make coat precursor. The degree of partial polymerization should be controlled so that the resulting partially polymerized ethylenically unsaturated monomer does not have an excessively high viscosity so that the binder precursor is a coatable material. An example of an acrylate monomer that can be partially polymerized is isooctyl acrylate. It is also within the scope of this invention to use a combination of a partially polymerized ethylenically unsaturated monomer with another ethylenically unsaturated monomer and/or a condensation curable binder.

In the manufacture of hand pads for use in the automotive applications mentioned above, the adhesive materials used as the make coat precursor in the present invention preferably comprise thermosetting phenolic resins such as resole and novolac resins, described in Kirk-Othmer, *Encyclopedia of Chemical Technology,* 3d Ed. John Wiley & Sons, 1981, New York, Vol. 17, pp. 384–399, incorporated herein by reference. Resole phenolic resins are made with an alkaline catalyst and a molar excess of formaldehyde, typically having a molar ratio of formaldehyde to phenol between 1.0:1.0 and 3.0:1.0. Novolac resins are prepared under acid catalysis and with a molar ratio of formaldehyde to phenol less than 1.0:1.0. A typical resole resin useful in the manufacture of articles of the present invention contains between about 0.75% (by weight) and about 1.4% free formaldehyde; between about 6% and about 8% free phenol; about 78% solids with the remainder being water. The pH of such a resin is about 8.5 and the viscosity is between about 2400 and about 2800 centipoise. Commercially available phenolic resins suitable for use in the present invention include those known under the trade designations "Durez" and "Varcum", available from Occidental Chemicals Corporation (N. Tonawonda, N.Y.); "Resinox", available from Monsanto Corporation; and "Arofene" and "Arotap", both available from Ashland Chemical Company; as well as the resole precondensate available under the trade designation "BB077" from Neste Resins, a Division of Neste Canada, Inc., Mississauga, Ontario, Canada. Organic solvent may be added to the phenolic resin as needed or desired.

Preferably, the adhesive binder used as the make coat is foamed or frothed prior to its application to the coatable surfaces of the open cells of the foam substrate. The binder composition can be an aqueous dispersion of a binder that hardens upon drying. Most preferred among these binder compositions are foamable, coatable, hardenable resole phenolic resins comprising a surface active agent to assist in the formation of the foam and to enhance its stability. An exemplary commercially available surface active agent is that known under the trade designation "SULFOCHEM SLS" from Chemron Corporation of Paso Robles, Calif. Such foaming agents (emulsifiers) or surfactants are added to the make coat resin and are applied to the foam substrate using coating methods compatible with liquid coatings. Amounts nearing 1.0% to 6.0%, and preferably about 3% of the total wet components have been used.

The foamable or frothable, coatable, hardenable resin composition useful as a make coat precursor in the present invention should be able to retain its froth form for a sufficient length of time to allow the application of the froth to the foam substrate before the foam breaks significantly. Preferably, the frothed make coat will begin to break soon after its application to the foam substrate so that the application of the abrasive particles can be accomplished in a manner which allows the particles to penetrate into the substrate beyond the uppermost surface layers of open cells. The resin compositions may be frothed by known methods, such as by mechanically foaming or frothing, by the injection and dispersion of insoluble gas, or by the use of chemical blowing agents that thermally or otherwise decompose to produce a gas-phase material. For the purposes of the present invention, the frothable, coatable, hardenable resin compositions should be frothable to a blow ratio, i.e., the ratio of frothed volume to that of the unfrothed starting material, of between 2:1 and 99:1. Phenolic frothed binder resin dispersions preferably will have a gas content of at least 20% by volume and more preferably between 50% and 99% (or a blow ratio of between 2:1 and 99:1, preferably between 5:1 and 25:1 and more preferably about 10:1). The labile foam must retain its structural integrity at least until the foam is applied to the fibers of the foam substrate in order to reduce the wet add-on weight of the resin being applied to the fiber layer. Frothing of the make coat provides a desired and economically attractive reduction in the add-on weight of the resin because the foamed resin is highly diluted with air, significantly increasing the volume of the resin while utilizing a smaller amount than would be required in the absence of frothing. The application of the frothed resin to the open cells of the foam substrate creates a substantially uniform monolayer of resin along the coatable surfaces of the open cells which, in turn, provides the bonding surface for the fine abrasive particles.

The frothed resin is applied to the foam substrate to provide an amount when dried to provide a sheath-like covering over the coatable surfaces of the open cells of the foam substrate. For foam substrates having the aforementioned densities, the frothed phenolic make coat precursor add-on weight is preferably within the range from about 33 $g/m^2$ to about 105 $g/m^2$. The specific add-on weights to be used will depend on several factors such as the nature of the foam substrate (e.g., density, cell types and shapes and the like) as well as the nature of the resin being used. The determination of appropriate make coat add-on weights is well within the skill of those practicing in the field.

The size coat precursor may be the same as the above discussed make coat precursor, or it may be different than the make coat precursor. The size coat precursor can comprise any of the aforementioned resinous or glutinous adhesives such as phenolic resins, urea-formaldehyde resins, melamine resins, acrylate resins, urethane resins, epoxy resins, polyester resins, aminoplast resins, and combinations and mixtures of the foregoing. Preferably, the size coat precursor will comprise a resinous adhesive similar or identical to the adhesive used in the make coat precursor. More preferably, the size coat precursor will comprise either a thermosetting resin or a radiation curable resin. Most preferably, the size coat precursor will comprise a thermosetting phenolic resin, as described above. The size coat precursor preferably is foamed prior to its application to the make coat, again to reduce the wet add-on weight of the resin so that the abrasive particles are not buried within the resin coating and rendered unavailable for use in the initial applications of the finished article. Preferably, the size coat precursor is frothed to a blow ratio between about 5:1 and about 25:1, more preferably about 20:1. The frothed size coat precursor is preferably applied to the foam substrate to provide an add-on weight which covers the abrasive particles with a thin and substantially uniform coating without burying the particles under the resin. Where the aforementioned frothed phenolic resins are applied to a foam substrate having the aforementioned density, preferably, the dried add-on weight for the size coat is within the range from about 33 $g/m^2$ to about 105 $g/m^2$. However, the specific add-on weights will depend on several factors such as the nature of the foam substrate as well as the nature of the resin being used. The determination of appropriate size coat add-on weights is well within the skill of those practicing in the field.

Abrasive Particles

Useful abrasive particles suitable for inclusion in the abrasive articles of the present invention include all known fine and larger abrasive particles having a median particle diameter of from 1 micron to about 600 microns with median particle diameters from about 10 microns to about 100 microns being preferred. Preferably, such fine abrasive particles are provided in a distribution of particle sizes with a median particle diameter of about 60 microns or less. In the preparation of hand pads to be used in the aforementioned automotive applications, for example, the median particle diameter may be smaller than 60 microns. In such articles, a median particle diameter of 40 microns or less is somewhat more preferred. Included among the various types of abrasive materials useful in the present invention are particles of aluminum oxide including ceramic aluminum oxide, heat-treated aluminum oxide and white-fused aluminum oxide; as well as silicon carbide, alumina zirconia, diamond, ceria, cubic boron nitride, garnet, ground glass, quartz, and combinations of the foregoing. Useful abrasive particles may also include softer, less aggressive materials such as thermosetting or thermoplastic polymer particles as well as crushed natural products such as nut shells, for example.

Those skilled in the art will appreciate that the selection of particle composition and particle size will depend on the contemplated end use of the finished abrasive article, taking into account the nature of the workpiece surface to be treated by the article and the abrasive effect desired. Preferably, the fine abrasive particles for inclusion in the articles of the invention comprise materials having a Moh's hardness of at least about 5, although softer particles may be suitable in some applications, and the invention is not to be construed as limited to particles having any particular hardness value. The particles are added to at least one of the first or second major surfaces of the foam substrate to provide a particle loading which is adequate for the contemplated end use of the finished article. In the preparation of articles for automotive application, for example, the fine abrasive particles may be applied to the foam substrate to provide an add-on weight within the range from about 63 to 168 $g/m^2$ (about 15 to 40 grains/24 $in^2$).

Additives

The make coat precursor or the size coat precursor or both can contain optional additives, such as fillers, fibers, lubricants, grinding aids, wetting agents, surfactants, pigments, dyes, coupling agents, photoinitiators, plasticizers, suspending agents, antistatic agents and the like. Possible fillers include calcium carbonate, calcium oxide, calcium metasilicate, alumina trihydrate, cryolite, magnesia, kaolin, quartz, and glass. Fillers that can function as grinding aids include cryolite, potassium fluoroborate, feldspar, and sulfur. Fillers can be used in amounts up to about 400 parts, preferably from about 30 to about 150 parts, per 100 parts of the make or size coat precursor, while retaining good flexibility and toughness of the cured coat. The amounts of these materials are selected to provide the properties desired, as known to those skilled in the art.

Organic solvent and/or water may be added to the precursor compositions to alter viscosity. Preferred viscosity values before foaming range between 10 to 10,000 cps (as measured using a Brookfield viscometer), usually between 50 to 1,000 cps, at room temperature (e.g., 25° C.). The selection of the particular organic solvent and/or water is believed to be within the skill of those practicing in the field and depends upon the thermosetting resin utilized in the binder precursor and the amounts of these resins utilized.

Method

Figure 3:
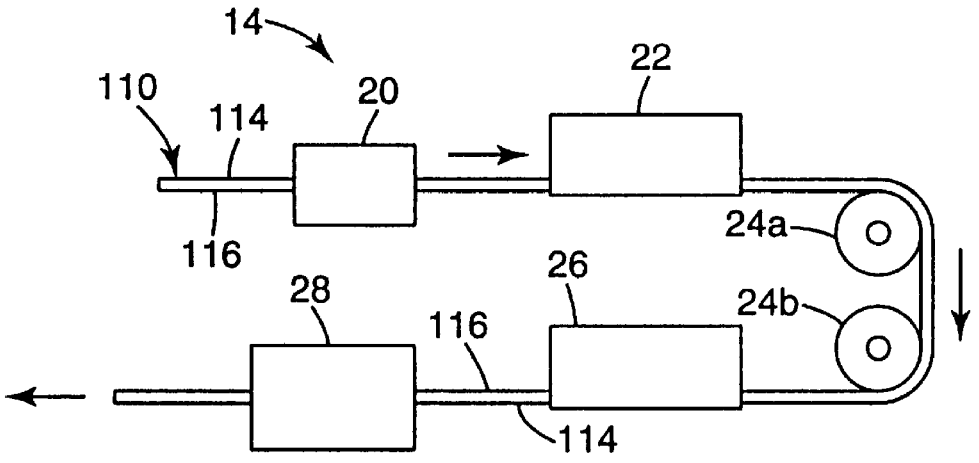
FIG. 3 is a partially schematic view of a method and apparatus for manufacturing foam abrasive articles according to the present invention.

As seen in FIG. 3, in the preparation of the articles of the invention the foam substrate 110 having first side 114 and second side 116 is fed into apparatus 14. The foam substrate 110 is first passed through coater 20 which applies first adhesive or make coat precursor to the foam substrate 110. The coater 20 can comprise any suitable coater known in the art, such as a spray coater, roll coater, dip coater, knife over roll coater, or the like. When applying the preferred foamed make coat precursor described below, the preferred coater 20 comprises a double roll coater with the foam substrate 110 passing through the nip formed by the two opposed rollers. Preferably, the pressure of the rollers is controlled so as to control the penetration of the make coat precursor resin into the thickness of the foam substrate. Such coaters are well known in the art need not be further described herein. The foamed make coat precursor is applied to the top roller from a frother through a slot die as is known in the art. In one preferred embodiment, the frother is of the type commercially available as a "F2S-8" from SKG Industries, West Lawn, Pa. Other suitable arrangements for applying the frothed make coat precursor to the foam substrate include but are not limited to: applying the make coat precursor with a slot die to the bottom roll or to both rolls of a double roll coater; applying the make coat precursor with a slot die directly to the foam substrate prior to entering the nip of a double roll coater; applying the make coat precursor with a slot die without a roll coater and optionally by drawing a vacuum across the foam substrate opposite the slot die, applying the make coat precursor to both sides of the foam substrate with opposed slot dies with or without subsequently passing the foam substrate through a roll coater; and applying the make coat precursor with a hose or duct transversing across the foam substrate.

After exiting the first adhesive coater 20, foam substrate 110 passes through first particle coater 22. First particle coater 22 is preferably configured to apply fine abrasive particles 112 to the first surface 114 of the foam substrate. As explained further below, the abrasive grains 112 will penetrate from surface 114 to some depth into the foam substrate 110 depending on the properties of the cells of the foam substrate. When it is desired to apply abrasive grains to second side 116 of the foam substrate 110, the foam substrate passes over rollers 24*a* and 24*b* so as to re-orient the foam substrate to have second side 116 facing up. The foam substrate 110 then passes through an optional second particle coater 26 configured to apply abrasive particles 112 to the second side 116 of foam substrate 110. Preferably, second particle coater 26 is of like construction as first particle coater 22. However, for certain applications, it may be preferable to use second coater 26 of a different type or configuration from first particle coater 22. Also, the second abrasive particle coater 26 may apply abrasive particles having either the same or different composition and/or size as the abrasive particles applied by the first abrasive particle coater 22. The particles may also be coated onto the foam substrate using electrostatic coating techniques.

After applying fine abrasive particles 112 to at least the first surface 114 of foam substrate 110, and optionally to second surface 116, the foam substrate 110 is preferably exposed to a heat source (not illustrated), such as infrared lamps or an oven, to heat the make coat precursor to the extent necessary to at least partially cure the resin. In some applications, it may be preferable to fully cure the make coat precursor at this step. Heating can be done with any source giving sufficient heat distribution and air flow. Examples of suitable heat sources include forced air oven, convection oven, infrared heat and the like. It is also within the scope of the invention to use radiation or actinic energy. For heat-activatable thermosetting resin foams, it is preferred that heating be for a sufficient amount of time to at least drive off solvent (e.g., water) and initiate at least partial curing (cross-linking) of the resin.

In a preferred embodiment, the foam substrate 110 optionally passes through second adhesive or size precursor coater 28 to apply an optional but preferred size coat precursor to the foam substrate 110 after it exits the second abrasive particle coater 26. Preferably, the size precursor coater is of the same configuration as the make precursor coater 20. For some applications, it may instead be desired to use a coater 28 of a different configuration from that of the first coater 20. In some applications, it may be preferred not to add the size coat.

Figure 4:
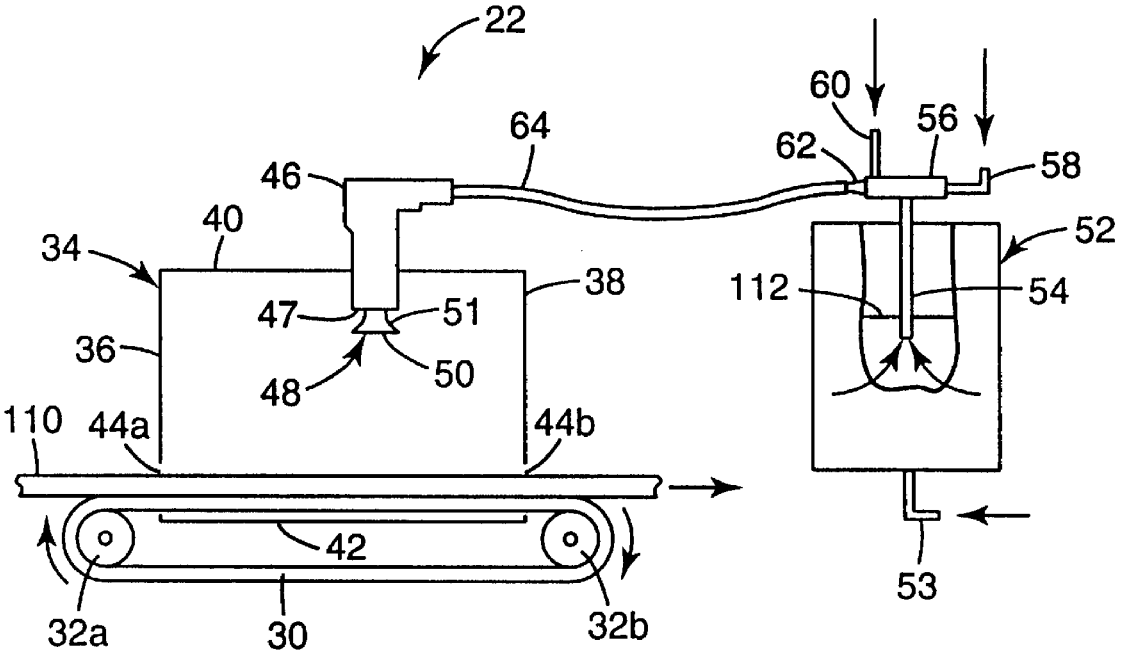
FIG. 4 is a partially schematic view of one embodiment of a particle coater according to the present invention.

A preferred embodiment of first particle coater 22 is illustrated in greater detail in FIG. 4. Foam substrate 110 is conveyed through the coater 22 by a carrier belt 30 which passes around rollers 32*a* and 32*b*, at least one of which is a drive roller. The foam substrate 110 passes through particle spray booth 34. Booth 34 includes first side 36, second side 38, top 40, and bottom 42. Booth 40 also includes front and back sides not illustrated. First side 36 includes entry slot 44*a* sized and configured to allow foam substrate 110 and carrier belt 30 to enter the booth 34. Second side 38 includes exit slot 44*b* sized and configured to allow foam substrate 110 and belt 30 to exit the booth 34. Slots 44*a*, 44*b* are located near the bottom of sides 36, 38 respectively. Mounted through an opening in the top 40 of the booth 34 is particle sprayer 46, having deflector 48 mounted at the exit 47 of the sprayer. The foam substrate 110, which at this point includes a make coat precursor thereon, is carried by belt 30 through the booth 34. As the foam substrate passes from entry slot 44*a* to exit slot 44*b*, particle sprayer 46 introduces particles 112 into the booth so as to coat the first side 114 of the foam substrate with abrasive particles. As described below, the particles 112 will penetrate to some depth into the foam substrate 110. The foam substrate 110, now comprising abrasive particles adhered to the foam substrate by the make coat precursor, then exits the booth 34.

In one preferred embodiment, the particle sprayer 46 receives an abrasive particle/air mixture from fluidizing bed 52. Abrasive particles 112 are fluidized in the bed 52 by fluidizing air (from a suitable source, not illustrated), introduced into the bed via fluidizing air inlet 53. The fluidizing air flow rate should be high enough to cause fluidization, without being so high so as to cause "worm holes" through the bed, i.e., a small number of discrete locations where the air passes through the particles without causing significant fluidization throughout the bed. The flow rate of fluidizing air should also be selected to minimize "stratification" of the particles 112, i.e., a state in which smaller particles tend to migrate toward the top of the bed while larger particles tend to migrate toward the bottom of the bed.

Atop the fluidizing bed 52 is a venturi inlet 56 as is well known in the art. In the illustrated embodiment, venturi 56 receives primary air from a suitable source via primary air inlet 58. The primary air passes through the venturi 56 drawing the mixture of fluidized particles and air through the draw tube 54 which extends from the venturi 56 into the fluidizing bed 52. Secondary air optionally can be added to the venturi inlet 56 via secondary air inlet 60. The secondary air is added to the flow of fluidized abrasive particles after the particles are drawn into the venturi to aid in delivering the fluidized abrasive particle/air mixture to the sprayer 46 via particle hose 64 which extends from the venturi exit 62 to the inlet of the particle sprayer 46.

The deflector 48 mounted in the exit 47 of the particle sprayer 46 redirects the fluidized abrasive particle/air mixture. Deflector 48 includes deflector top 49 (illustrated in FIGS. 5 and 6), deflector bottom 50, and deflector wall 51. To obtain the preferred uniform distribution of fine abrasive particles on foam substrate 110 described above, the present inventors have discovered that it is preferable to redirect the flow of the fluidized abrasive particle/air mixture so as not to spray the mixture directly into the foam substrate 110. Instead, the desired uniform distribution of abrasive particles 112 is achieved with the method and apparatus of the present invention by creating a uniformly dispersed cloud of fine abrasive particles in the spray booth 34 above the foam substrate 110 having the liquid make coat precursor thereon. The cloud then deposits, preferably by settling due to gravity onto the foam substrate 110 in the desired uniform pattern. Such a uniformly dispersed cloud helps prevent the individual fine abrasive particles from agglomerating or clumping together. Instead, the abrasive particles settle from the cloud onto the foam substrate having the make coat thereon as illustrated in FIG. 4. In one preferred arrangement, the deflector bottom 50 has a diameter of 32 mm (1.26 inches), the bottom edge of the deflector extends 20 mm (0.79 inches) from the exit of the spray gun, and is held at a height of 155 mm (6.1 inches) above the foam substrate 110. Of course, other arrangements fall within the scope of the present invention. For example, the size of the deflector, the shape of the deflector, the contour of wall 51, the number and location of particle sprayers 46, the height of the deflectors above the foam substrate, the speed of the foam substrate 110, and the air pressure and ratio of abrasive particles in the particle/air mixture can each be varied. Such parameters can be varied to achieve the desired add-on weight of abrasive particles, the desired penetration into the foam substrate 110 of the abrasive particles, and the desired uniformity of the abrasive particles 112 on the foam substrate 110.

In one preferred embodiment, sprayer 46, fluidizing bed 52, and controller (not illustrated) is a commercially available system known as MPS 1-L Manual Powder System, including model PG 1-E Manual Enamel Powder Gun, available from Gema, an Illinois Tool Works Company, of Indianapolis, Ind., with a round deflector 48 substantially as illustrated in FIG. 4.

In another preferred embodiment, the abrasive particle spray apparatus is of the type commercially available from Binks Manufacturing Company (Sames), of Franklin Park, Ill., and includes a 50 lb. Fluidized bed, a GCM-200 Gun Control Module, a SCM-110 Safety control Module, a STAJET SRV Type 414 gun, with a standard powder pump.

Figure 5:
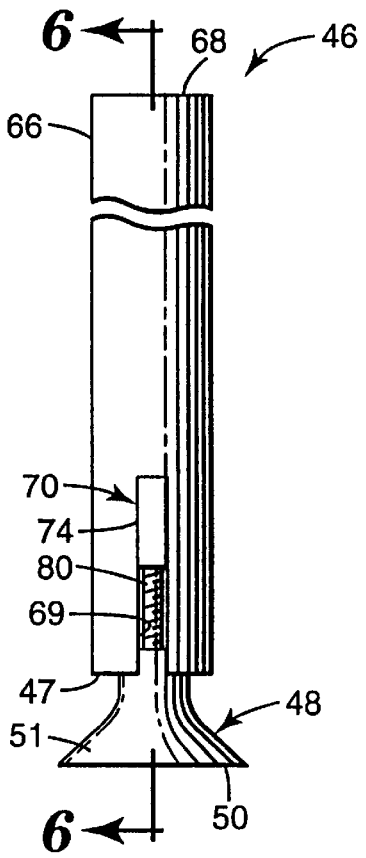
FIG. 5 is an elevational view of an alternate particle sprayer for use with the present invention.
Figure 6:
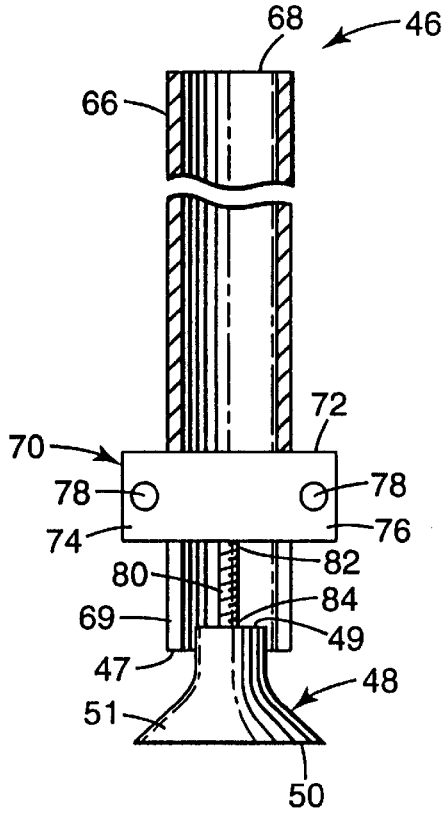
FIG. 6 is a partial cross-sectional view of the nozzle of FIG. 5 taken along line 6—6.

Another preferred embodiment of particle sprayer 46 is illustrated in FIGS. 5 and 6. In this embodiment, the sprayer comprises an elongate tube 66 having an exit 47 at one end and an inlet 68 at the opposite end of the tube. In use, this embodiment of the sprayer 46 has the abrasive particle/air mixture hose 64 attached to the inlet 68 as is illustrated with respect to the earlier described embodiment of FIG. 4. The embodiment of the sprayer 46 illustrated in FIGS. 5 and 6 is mounted in spray booth 34 and operates as described with respect to the embodiment of particle coater 22 illustrated in FIG. 4.

Returning to FIGS. 5 and 6, sprayer 46 includes particle deflector 48 mounted at exit 47 of tube 66. Deflector 48 is mounted to the tube 66 by any suitable mounting means. In one preferred embodiment, deflector mount 70 includes a base 72 comprising a generally rectangular plate having a first end 74 and a second end 76. Base 72 is sized and configured to fit in slot 69 in the end of tube 66 proximate the exit 47. Mount 70 can be permanently or removably mounted to the tube 66. In the illustrated embodiment, base 72 is releasably held in slots 69 by a spring, clip, or other suitable fastener (not illustrated) affixed to holes 78 in the first and second ends of base 72. Extending from base 72 is a threaded rod 80 having a first end 82 affixed to the base (such as by brazing, for example) and second end 84 extending beyond the exit 47 of tube 66. Threaded rod 82 is configured to engage with a like-threaded hole in the top 49 of deflector 48. This allows the position of deflector 48 to be conveniently adjusted with respect to the exit 47 of the tube 66 by rotating the deflector 48. This allows for varying the direction of motion of the particles 112 leaving the sprayer 46 as described above. Deflector 48 also includes bottom 50 opposite top 49, and deflector wall 51 extending between top 49 and bottom 50.

Figure 6A:
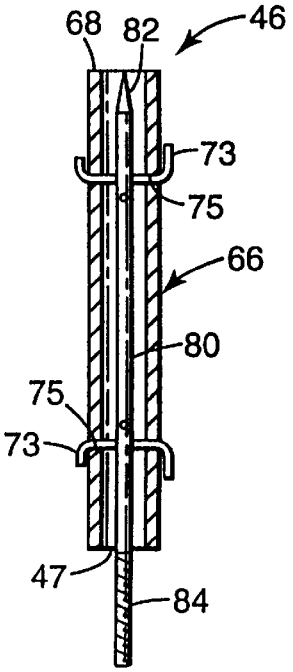
FIG. 6A is a view like FIG. 6 of an alternate embodiment of the nozzle.

An alternate embodiment of sprayer 46 is illustrated in FIG. 6A. In this embodiment, threaded rod 80 is elongated, and includes a tapered end 82 to help direct the flow of abrasive particles through tube 66. Pins 73 extend through holes 75 in the wall of the tube 66, and extend through holes in the rod 80, to mount the rod 80 in the sprayer 46. In one embodiment, the tapered end 82 of rod 80 ends at the inlet 68. In other embodiments, the end 82 can extend beyond the inlet 68, or the inlet may extend beyond the end 82 of the rod. Deflector 48 is mounted on threaded end 84 as described above.

The tube 66 and deflector 48 should be sized and configured to provide the desired uniform spray pattern of abrasive particles 112. In one preferred embodiment, tube 66 is approximately 61 cm (24 inches) long, has an inside diameter of 1.08 cm (0.425 inches), and an outside diameter of 1.27 cm (0.5 inches), and is constructed of stainless steel. It is understood that other sizes and materials of tube 66 fall within the scope of the present invention.

Figure 7:
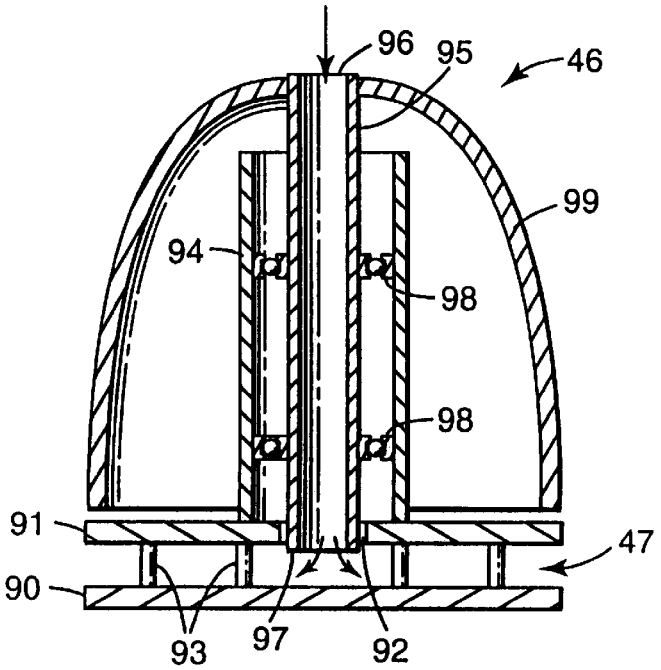
FIG. 7 is a cross-sectional view of a further alternate embodiment of a particle sprayer for use with the present invention.
Figure 8A:
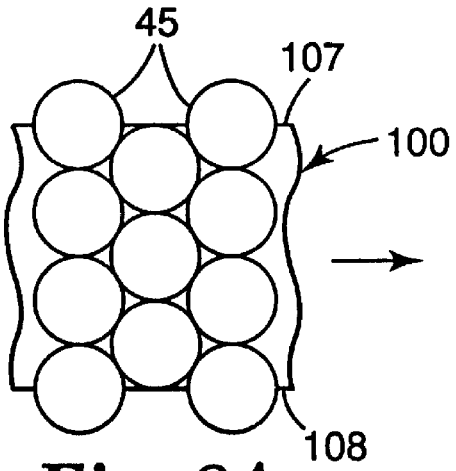
FIGS. 8A through 8D are schematic plan views of alternate patterns of the coating apparatus of the present invention.
Figure 8B:
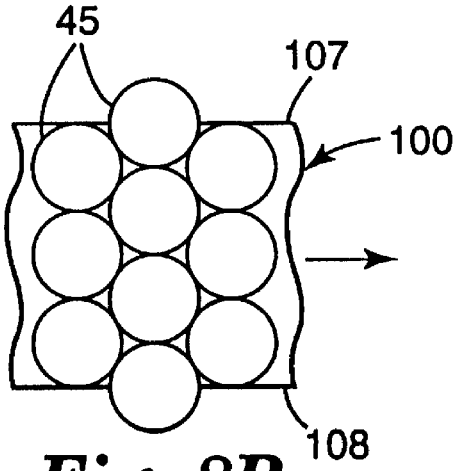
Figure 8C:
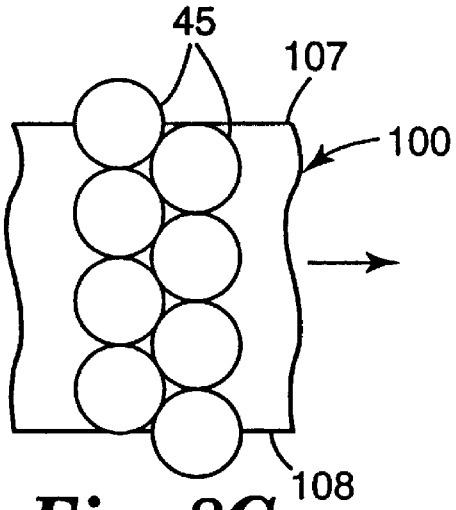
Figure 8D:
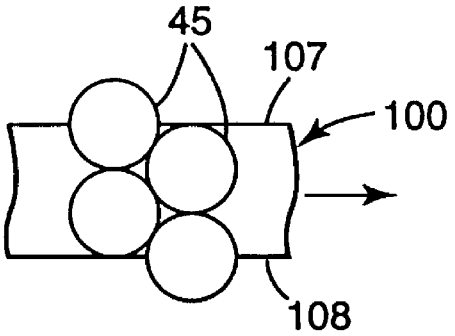

Another preferred embodiment of the abrasive particle sprayer 46 is illustrated in FIG. 7. In this embodiment, the sprayer 46 comprises rotating first and second circular discs 90 and 91, respectively, joined by studs 93. Second disc 91 has a hole 92 in the center thereof. Second disc is joined to rotating shaft 94 which is concentric with the center hole 92. Rotating shaft 94 is rotatably mounted on the outside of stationary feed tube 95 by means of bearings 98, such that rotating shaft 94 is concentric with stationary feed tube 95. In this manner, rotating shaft 94, first plate 90, and second plate 91 are able to rotate together as a unit about stationary feed tube 95. The rotating shaft 94 can be driven by any suitable power means, such as an air motor (not illustrated). Feed tube 95 includes inlet 96 and outlet 97. In one preferred embodiment, inlet 96 of the feed tube 95 is attached to abrasive particle/air mixture hose 64, and the particle sprayer 46 is mounted on the top 40 of particle booth 34 as explained with regard to the embodiment of FIG. 4. In such an arrangement, the particle sprayer 46 receives fluidized abrasive particles from the fluidizing bed 52. In a variation of this embodiment, a vibratory feeder can be used in place of the fluidizing bed 52. The vibratory feeder is connected to feed abrasive particles into the inlet 96 of feed tube 95.

In operation, the rotating shaft 94 is driven so as to cause plates 90 and 91 to rotate. Fine abrasive particles pass through feed tube 95 and exit from outlet 97. Tube outlet 97 is positioned through hole 92 in second plate 91 such that the abrasive particles enter the space between first and second plates 90, 91. The abrasive particles strike the top surface of rotating plate 90, and will be dispersed through exit 47 in a direction generally parallel to the plane of first and second plates 90, 91. The particles preferably form a cloud that deposits, preferably by settling due to gravity onto the surface of foam substrate 110 as explained with regard to the embodiments described above. In one preferred embodiment, particle sprayer 46 comprises a Binks EPB-2000, commercially available from Binks Manufacturing Company (Sames), of Franklin Park, Ill., and the abrasive particles are fed to the particle sprayer by a vibratory pre-feeder commercially available as "Type 151" from Cleveland Vibratory Company, Cleveland, Ohio. The plates 90, 91 of the particle sprayer are preferably driven at 6,000 to 9000 RPM, however slower and faster speeds are within the scope of the present invention. The abrasive particle feed rate, type of particle feeder, and rotational speed of the plates can be selected to provide the desired abrasive particle spray pattern, desired abrasive particle add-on weight, and desired degree of penetration into foam substrate 110 of the abrasive particles.

What is common to the preferred embodiments described herein is that the particle sprayer includes means to change the direction of flow of particles 112 exiting the sprayer from perpendicular to the foam substrate 110, to a direction approaching, or exceeding, a plane parallel to foam substrate 110. Such directions are described with reference to the area immediately surrounding the exit 47 of particle sprayer 46. Thereafter, the fine particles 112 preferably disperse into a cloud of particles in the booth 34. The particles then settle from the cloud onto the foam substrate under the influences of gravity. Thus in one preferred embodiment of the inventive method, immediately before the particles adhere to foam substrate 110, gravity has a greater effect on the motion of the abrasive particles than does the momentum imparted by the particle sprayer 46. In some applications, the momentum imparted by the particle sprayer 46 will have little or no effect on the motion of the particles 112 immediately before the particles adhere to foam substrate 110. In other applications, for example where greater penetration of abrasive particles 112 into the foam substrate 110 is desired, the above apparatus parameters and configuration may be selected such that the downward momentum imparted to the particles 112 by the sprayer 46 will have a greater effect on the motion of the particles immediately before the particles adhere to the foam substrate.

In the embodiments described with respect to FIGS. 3, 5, and 6, the means for directing the flow of particles 112 exiting the particle sprayer 46 is the deflector wall 51 of deflector 48. Preferably, the location of the deflector 48 relative to the exit 47 of the particle sprayer can be varied to obtain the desired redirection of flow of abrasive particles 112 exiting the particle sprayer. It will be appreciated that without the deflector 48, the abrasive particles exiting the particle sprayer 46 will travel generally parallel to the longitudinal axis of the sprayer, which is generally perpendicular to the foam substrate 110. Generally, the closer the wall 51 and bottom 50 of the deflector are to the exit 47, the greater change in direction of motion of particles 112 from perpendicular to the foam substrate 110 will be. Moving the wall 51 and bottom 50 of the deflector further from the exit 47 will reduce the amount the direction of motion of the particles is varied from perpendicular to the foam substrate 110. In the embodiment described with respect to FIG. 7, the means for directing the flow of abrasive particles is the rotating plates 90, 91.

In some applications, it may be desirable to place hard inserts, such as ceramic inserts, into those components of the apparatus 14 that are prone to wear under prolonged flow of abrasive particles through the components. This may be desirable, for example, in the particle sprayer 46, the venturi inlet 56, and the deflector 48. Such inserts would prolong the useful life of certain components of apparatus 14, but would not be expected to have a significant effect on the performance of the apparatus.

For some applications, it is preferable to use a plurality of particle sprayers 46 in a single spray booth 34. Preferably, each of the particle sprayers are of like configuration, however it is understood that different types of particle sprayers could be used in a single booth. The particle sprayers 46 should be arranged in a pattern that provides a uniform coating of abrasive particles 112 to the foam substrate 110 as the foam substrate passes through the booth 34. This can be accomplished by arranging the plurality of particle sprayers 46 such that each location across the width of the foam substrate 110 from first edge 117 to second edge 118 traverses through an equal number of spray patterns 45 caused by each of the particle sprayers 46. Exemplary particle sprayer arrangements are illustrated schematically in FIGS. 8A through 8D. These figures are schematic top views of the foam substrate 110 passing under the spray patterns 45 created by particle sprayers 46 mounted in the top 40 of the booth 34 (not shown). It is possible to vary the flow rates of each of the plurality of sprayers 46, or to use different configurations of sprayers 46 to obtain a desired coating pattern of abrasive particles 112 on foam substrate 110. It is also possible to oscillate or reciprocate the particle sprayers 46 to achieve a desired spray pattern as is known in the art.

When using a plurality of particle sprayers 46, it is possible to use a like number of particle coaters 22 as illustrated in FIG. 4, where each particle sprayer receives abrasive particles 112 for a respective fluidizing bed 52. In some applications, it is preferable to feed a plurality of particle sprayers 46 from a single fluidizing bed 50. In one such arrangement, a plurality of venturi injectors 56 are mounted on a single fluidizing bed. In an alternate arrangement, a plurality of volumetric control auger feeders are mounted on the side wall of a fluidizing bed to draw a desired rate of fluidized abrasive particle/air mixture from the fluidizing bed 50. The operation and design of such feeders is well known and need not be further discussed. Each auger feeder deposits the abrasive particles into a venturi injector 56 as described above. Each venturi injector 56 is connected to an abrasive particle/air mixture hose 64 for conveying the abrasive particle/air mixture to a particle sprayer 46 as described above. In one preferred embodiment, the fluidizing bed 50 having a plurality of auger feeders mounted thereon is of the type commercially available as the "Powder Delivery Control Unit" Gema, an Illinois Tool Works Company, of Indianapolis, Ind. It is also within the scope of the invention for the auger feeder to feed abrasive particles from a volumetric feeder of the type commercially available as "Dry Material Feeder" from AccuRate of Whitewater, Wis.

It is also within the scope of the present invention to include additional particle sprayers configured to spray abrasive particles onto the foam substrate 110 with enough force to achieve greater penetration into the center portion of the foam substrate. Such additional particle sprayers can be included in the spray booth 34 along with the particle sprayers 46 described above, either in the arrangement of particle sprayers 46, or arranged to spray the foam substrate 110 before or after the foam substrate passes under sprayers 46. Such additional sprayers could also be arranged in a second particle spray booth before or after the sprayers 22, 26, described above. Preferably, the additional sprayers are arranged to deposit abrasive particles onto the foam substrate before the sprayers 46, so as not to disturb or disrupt the advantageous spray pattern achieved by the sprayers 46. Such a combination of sprayers can be used to provide a foam substrate 110 having the advantageous fine particle distribution at surfaces 114, 116 as described herein, along with particles in the center portion of the foam substrate for a longer-life abrasive article.

In one preferred embodiment, the foam substrate 110 has a width from first edge 117 to second edge 118 of 61 cm (24 inches) and is fed through apparatus 14 at a foam substrate speed of from about 3 to 30 meters/minute (10 to 100 feet/minute), more preferably 16 meters/minute (52.5 feet/minute). The first adhesive coater 20 is a double roll coater with the foam substrate 110 passing through the nip formed by the two opposed rollers. The frothed make coat precursor is applied to the top roller from a frother through a slot die as is known in the art. In one preferred embodiment, the frother is of the type commercially available as a "F2S8" from SKG Industries, West Lawn, Pa. The fine abrasive particles 112 are applied by eight particle sprayers 46 generally as described with respect to FIGS. 5 and 6, fed by eight venturi injectors 56 mounted on a fluidizing bed 52. The spray pattern of the injectors is generally as illustrated with respect to FIG. 8B. The abrasive particles 112 preferably comprise aluminum oxide particles having a median particle size of about 60 microns, applied to each side in an amount of from about 63 to 168 grams/$m^2$ (about 15 to 40 grains per 24 square inch), more preferably in an amount of about 105 grams/$m^2$ per side (25 grains per 24 square inch). The make coat precursor is then at least partially cured. The second adhesive coater 26 preferably is of the same type as the first adhesive coater 20. The size coat precursor preferably has the same composition as the make coat precursor, is frothed to a desired blow ratio, and is applied in an amount to provide a suitable dry add-on weight as mentioned above. The parameters for the Gema particle coater described above are as follows: fluidizing air introduced through inlet 53 at a pressure of from about 2 to 15 psi; primary air introduced into inlet 58 of venturi 56 at a pressure of up to 90 psi, preferably 30 to 60 psi; secondary air introduced into inlet 60 at a pressure of from 0 to about 90 psi, preferably from 0 to about 20 psi.

The methods and apparatuses described herein provide the advantageous abrasive article as illustrated in FIG. 2. By applying the foamed make coat precursor in the manner described herein, the tendency for the make coat precursor to migrate or concentrate and agglomerate is reduced. In this manner, the coatable surfaces of the open cells 100 of the foam substrate are uniformly coated with the make coat precursor, allowing the abrasive particles 102 to be coated onto and adhered to the coatable surfaces in a more uniform distribution. And by coating the make coat precursor and abrasive particles in different steps, the abrasive particles are less likely to be "buried" within the make coat as is prone to happen in the prior art method of applying a make coat precursor/abrasive particle slurry. In the finished articles made by the methods and apparatuses of the invention, the size coat provides a thin coating of resin over the fine abrasive particles without burying the particles within the resin. When observed under a microscope, for example, the individual particles are observed to be anchored to the coatable surfaces of the open cells and to extend outwardly from the coatable surfaces of the open cells. In this construction, the fine abrasive particles are positioned in the article to be immediately abrasively effective in the initial applications of the finished article. Moreover, the particles are strongly adhered to the coatable surfaces of the cells of the foam substrate to provide an abrasive article with a satisfactory work life.

TEST METHODS

Paint Abrasion Test

The Paint Abrasion test was used to demonstrate the relative efficacy of the articles of the present invention to efficiently abrade paint coatings from wooden test panels. Painted wood panels were prepared from "BB" grade Baltic birch plywood panels measuring 18"×24"×0.5" thick (46.7 cm×61 cm×1.3 cm thick). Each panel was wiped with a clean, dry towel to remove loosely-adhered detritus. Three coats of paint were applied to each clean panel. One prime coat (yellow latex, "Fuller Obrien Versiflex acrylic latex (Highway Yellow)", product number 615-35, available from ICI Paints, Imperial Chemical Industries, Slough, Berkshire, UK) and two top coats (light blue, "Sherwin Williams Pro Classic Interior Alkyd Semi Gloss Enamel", product number B34 W220 (tinted light blue in the lab with universal tinting colors), available from Sherwin-Williams Company, Orlando, Fla.). Each coat was spray applied to a wet film thickness of 5 mil (0.127 mm) (for a total wet film thickness of 15 mil (0.381 mm). Each coat was air dried at ambient room conditions for 24 hours before subsequent coats were applied. Once the final coat was applied the test panels were cured at ambient conditions for at least two weeks, then force cured for 2 hours at 200° F. (93° C.) before use. Ten panels were prepared at the same time. The panels were then ready for testing. The test apparatus consisted of an 8 lb. (3.64 kg) steel block of dimensions 3"×4.25"×2" thick (7.6 cm×10.8 cm×5.1 cm thick) having a 62.5 mils thick foam rubber pad adhesively attached to a 3"×4.25" face, the foam rubber pad having a pressure-sensitive adhesive attached to its resultant exposed major surface for the purpose of securing the test specimens. An 18" (45.7 cm) long aluminum wand was attached to the block via a hinge to allow the wand to pivot during operation. The wand provided a means for manually traversing the 24" dimension of the test panel with the test block to provide a nominal stroke length of 24" (61 cm) at a rate of 30 strokes per minute.

Test specimens of the abrasive articles were die cut to 2.25"×4.25" (5.72 cm×10.8 cm) dimensions and were individually mounted on the foam rubber pad for testing. The total assembled apparatus applied a load of 9.26 lb. (4.2 kg) to the test specimen. A test panel was weighed on a balance to the nearest 0.05 grams and located so that the test apparatus with its mounted test specimen would slide parallel to the long axis of the apparatus to abrade a path 24" (61 cm) long by 2.25" (5.72 cm) wide. The stroke was repeated for 30 strokes, after which the panel was cleared of abraded debris with compressed air or wiping with a clean cloth and weighed again, with the difference between the final and initial weights being recorded as the abrasive cut of the specimen. The panel was re-mounted and again abraded along the same path to a total of 150 strokes, with cut data collected by weighing every 30 strokes.

Surface finish data were then collected by using a "Perthen Perthometer Surface Contact Stylus Profilometer", available from Mahr Corporation, Cincinnati, Ohio. The stylus was advanced transversely across the abraded area perpendicular to the abrasion path. Measurements of $R_a$ (RMS average of base-to-peak measurements across the trace length)and $R_{max}$ (maximum peak-to-peak distance within each trace) were recorded. These measurements were made at three places across the abraded surface and average $R_a$ and $R_{max}$ were reported.

MATERIALS DESCRIPTION

In the Examples that follow, the materials are referred to as follows:

Foam Substrate: is a thick open cell polyester foam commercially available under the trade designation "R-600U" from illbruck, Incorporated, Minneapolis, Minn. having a pore size of between 50 and 100 ppi (0.5–0.25 mm mean pore diameter).

Phenolic Resin: is a resole precondensate commercially available under the trade designation "BB077" from Neste Resins Canada, a Division Of Neste Canada Inc., Mississauga, Ontario, Canada.

Surfactant: is a surfactant commercially available under the trade designation "Sulfochem SLS", from Chemron Corporation, Paso Robles, Calif.

Abrasive Particles: is $Al_2O_3$ particles.

AMP 95: is 2 amino 2 methyl 1 propanol, 95% aqueous solution, from Ashland Chemical, Co., Columbus Ohio.

Urea: is 46% nitrogen prilled industrial grade urea, BP Chemicals, Gardena, Calif.

Comparative Example A: is a "Mercury Extra Fine" sanding sponge, available from Mercury Foam Corporation, Hackensack, N.J. The sponge comprises a polyether urethane substrate coated with a nitrile rubber adhesive and aluminum oxide particles with grade 180.

Comparative Example B: is an Oakey™ Fine/Medium Contour Sanding Sponge, available from EAC (English Abrasives and Chemicals Ltd.)Doxey Road, Strafford ST161EA, England. This sponge comprises a polyether urethane substrate coated with a nitrile rubber adhesive and aluminum oxide particles with grade P220.

EXAMPLES

The following non-limiting examples further illustrate the utility, performance and comparative advantages of the articles of the invention. Unless otherwise indicated, all parts and percentages are by weight.

Examples 1 and 2

Examples 1 and 2 were made as follows: A make coat precursor having the composition set forth in Table 1 was frothed using a frother (commercially available under the trade designation "F2S-8" from SKG Industries, West Lawn, Pa.) as per the manufacturer's recommended procedure with a blow ratio of about 17:1. The frothed make resin was applied through a hose to the top roll of a vertical roll coater. The Foam Substrate, in passing through the nip of the roll coater, had its top surface impregnated with the frothed resin. Nip pressure was limited, typically to 10 psi, for the purpose of coating only the top surface of the substrate (i.e. not impregnating the entire thickness of the substrate). Within 30–60 seconds the abrasive particles were applied to the uncured make coat precursor using the method and apparatus described in FIG. 4, except using the particle sprayer shown in FIGS. 5 and 6. The Foam Substrate was passed underneath the sprayer at a foam substrate speed of approximately 2.3 meters/minute (7 feet/minute). Within another 30–60 seconds the coated Foam Substrate was cured for approximately 2 minutes at 170° C, followed by approximately 5 minutes at 130° C. The coated Foam Substrate was then sent through the roll coater once more, wherein a size coat described in Table 1 was applied in the same manner as the make coat. In this step abrasive particles were not applied, and the size resin was cured in the same manner as the make coat. Target coating weight for both the make and size resins was 0.67 grams per 10.2×15.2 cm sample (g/m$^2$), and for the Abrasive Particles was 1.0 grams per 10.2×15.2 cm sample (g/m$^2$). The samples were tested according to the Paint Abrasion Test described above. Results are shown in Tables 2 and 3.

TABLE 1

| | | |
|---|---|---|
| Make | Phenolic Resin | 59 parts |
| | Water | 35 parts |
| | Surfactant | 3 parts |
| | AMP 95 | 1.5 parts |
| | Urea | 1.5 parts |
| Size | Phenolic Resin | 59 parts |
| | Water | 35 parts |
| | Surfactant | 3 parts |
| | AMP 95 | 1.5 parts |
| | Urea | 1.5 parts |

TABLE 2

| Sample | Total cut (grams) after 150 cycles |
|---|---|
| Example 1 | 2.96 |
| Example 2 | 3.05 |
| Comparative Example A | 3.43 |
| Comparative Example B. | 2.29 |

TABLE 3

| Sample | $R_a$ ($\mu$ in.) | $R_{max}$ ($\mu$ in.) |
|---|---|---|
| Example 1 | 17 | 159 |
| Example 2 | 21 | 210 |
| Comparative Example A | 43 | 319 |
| Comparative Example B | 16 | 132 |

The results show that the Examples of the invention cut as well or better than a product with a coarser mineral and providing a comparable or superior finish.

What is claimed is:

1. A flexible abrasive article comprising:

a flexible and resilient foam substrate having first and second major substrate surfaces, at least one of the surfaces having a plurality of open cells substantially across the substrate surface, the open cells having coatable surfaces defined by interconnected voids; and a plurality of abrasive particles adhered to said coatable surfaces of said open cells in a substantially uniform manner wherein said particles are adhered to said coatable surfaces using a cured hard, non-elastomeric adhesive.

2. The flexible abrasive article of claim 1 wherein the cured hard, non-elastomeric adhesive is a cured thermosetting adhesive selected from the group consisting of phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof.

3. The flexible abrasive article of claim 2 wherein the cured thermosetting adhesive provides a substantially uniform resin layer over the coatable surfaces of said open cells of the foam substrate.

4. The flexible abrasive article of claim 3 wherein the substantially uniform resin layer comprises separate make and size coatings.

5. The flexible abrasive article of claim 1 wherein the abrasive particles comprise material selected from the group consisting of aluminum oxide, silicon carbide, alumina zirconia, diamond, ceria, cubic boron nitride, garnet, ground glass, quartz, and combinations thereof.

6. The flexible abrasive article of claim 1 wherein the abrasive particles have a median diameter of about 100 microns or less.

7. The flexible abrasive article of claim 1 wherein the abrasive particles have a median diameter ranging from about 1 micron to about 600 microns.

8. The flexible abrasive article of claim 1 wherein the foam substrate is selected from a synthetic polymer foam substrate and a natural sponge substrate.

9. The flexible abrasive article of claim 1 wherein the foam substrate is an open celled foam substrate.

10. The flexible abrasive article of claim 1 wherein the foam substrate is a polyurethane foam.

11. The flexible abrasive article of claim 1 provided in a roll form with or without perforations.

* * * * *